US005848596A

United States Patent [19]

Zelenik

[11] Patent Number: 5,848,596

[45] Date of Patent: Dec. 15, 1998

[54] SMOKING ASSEMBLY FOR HOLDING A PIPE, LIGHTER, AND SMOKING MATERIAL

[76] Inventor: Steven E. Zelenik, 1380 S. Elmhurst Rd., Apt. 115, Mount Prospect, Ill. 60056

[21] Appl. No.: 876,911

[22] Filed: Jun. 17, 1997

[51] Int. Cl.[6] ..... A24F 23/04

[52] U.S. Cl. ..... 131/329; 131/180; 206/244

[58] Field of Search ..... 131/329, 180, 131/181, 185; 206/244, 250, 253, 236

[56] References Cited

U.S. PATENT DOCUMENTS

| | | | |
|---|---|---|---|
| D. 252,558 | 8/1979 | Beck | D27/36 |
| D. 289,449 | 4/1987 | Stutzera | D27/36 |
| D. 289,801 | 5/1987 | Fugisawa | D27/36 |
| D. 366,950 | 2/1996 | McKinnie | 131/329 |
| 498,695 | 5/1893 | Powell | 131/180 |
| 1,039,892 | 10/1912 | Buckow | 131/180 |
| 1,729,967 | 10/1929 | Russell | 131/180 |
| 2,455,583 | 12/1948 | Ireson | 131/180 |
| 2,595,534 | 5/1952 | Nicholson et al. | 131/329 |
| 3,608,704 | 9/1971 | Kopp | 131/329 |
| 3,698,400 | 10/1972 | Tucker | 131/185 |
| 4,190,062 | 2/1980 | Paden | 131/329 |
| 4,214,658 | 7/1980 | Crow | 131/329 |
| 4,223,687 | 9/1980 | Sandeen | 131/329 |
| 4,276,892 | 7/1981 | Iaquinta | 131/329 |
| 4,310,297 | 1/1982 | Kitabayashi | 431/254 |
| 4,325,692 | 4/1982 | Kitabayashi | 431/254 |
| 4,430,060 | 2/1984 | Racek | 431/276 |
| 4,457,697 | 7/1984 | Kitabayashi | 431/254 |
| 4,487,570 | 12/1984 | Lowenthal | 431/254 |
| 4,750,613 | 6/1988 | Kopp | 131/329 |
| 4,810,187 | 3/1989 | Nitta | 431/130 |
| 5,145,357 | 9/1992 | Chou | 431/255 |
| 5,465,738 | 11/1995 | Rowland | 131/329 |
| 5,580,239 | 12/1996 | Jang | 431/253 |

FOREIGN PATENT DOCUMENTS

| | | | |
|---|---|---|---|
| 340656 | 10/1959 | Switzerland | 131/180 |
| 390732 | 4/1933 | United Kingdom | 131/329 |

*Primary Examiner*—John G. Weiss
*Assistant Examiner*—Charles W. Anderson
*Attorney, Agent, or Firm*—Trexler, Bushnell, Giangiorgi & Blackstone, Ltd.

[57] ABSTRACT

A complete smoking assembly including a housing that defines a first chamber for storing smoking material and a aperture, a top cover associated with the housing, and a lighter contained substantially within the housing for emitting through the aperture a flame for igniting outside of the housing a portion of the smoking material removed from the housing. The aperture is defined along a side of the housing. The assembly includes a smoking pipe for removing the portion of the smoking material from the first chamber, and the housing defines an elongated channel for removably receiving the smoking pipe. The top cover is slidingly engaged with the housing and is adapted to open and close the first chamber and open and close the channel. The lighter is configured to be substantially received within the housing in a neat and compact manner.

25 Claims, 2 Drawing Sheets

SMOKING ASSEMBLY FOR HOLDING A PIPE, LIGHTER, AND SMOKING MATERIAL

The present invention relates to a smoking assembly adapted to store smoking material.

BACKGROUND

Smoking assemblies adapted to hold a smoking pipe and smoking material are heretofore known. U.S. Pat. No. 4,214,658 to Crow, for example, discloses a smoking system comprising a smoking pipe and housing that defines two cavities, one of which is shaped to receive the smoking pipe and the other of which is shaped to store smoking material. The Crow system also includes a top cover slidably mounted on the receptable and adapted to cover the first and second cavities. The smoking pipe can be stored and also can be removed and packed with smoking material quickly and easily for smoking. The Crow assembly does not, however, provide a complete smoking assembly because it does not include a lighter for igniting the smoking material for smoking.

Accordingly, it is an object of the present invention to provide a complete smoking assembly that includes a lighter for igniting smoking material stored by the assembly.

It is a further object of the present invention to provide such a complete smoking assembly that is neat and compact, easy to use, and easy to store and transport.

SUMMARY

In accordance with these and other objects, a smoking assembly is provided that includes a housing defining a first chamber for storing smoking material and an aperture, a first or top cover associated with the housing, and a lighter contained substantially within the housing for emitting a flame through the aperture to ignite outside the housing a portion of the smoking material removed from the housing. The first chamber defined by the housing has an open end and the top cover is adapted to open and close the open end of the first chamber.

Desirably, the lighter is received substantially within a second chamber defined by the housing and the aperture is defined on a side of the housing. The lighter preferably includes a generally L-shaped lighter switch positioned such that the switch can be activated adjacent one end of the housing, and a valve stem positioned adjacent the aperture defined by the housing so that flame emitted by the lighter can pass from the valve stem through the aperture. The lighter also includes an igniter that desirably extends substantially perpendicular to the valve stem.

In a preferred embodiment, the smoking assembly also includes a smoking pipe for removing and receiving the portion of the smoking material from the first chamber, and the housing further defines an elongated channel that removably accepts the smoking pipe. The channel defined by the housing also has an open end, which also may be opened and closed by the top cover. After removing the portion of the smoking material from the housing, the smoking pipe is used to hold the portion of the smoking material so that it can be ignited by the lighter for smoking.

The lighter may have any suitable construction and is joined to the housing in any suitable manner. In accordance with a preferred embodiment, however, the lighter is configured and joined to the housing in a manner such that the housing can be manually held and the lighter manually activated at one time by the same hand. If desired, a shell may be included adjacent the longitudinal end of the housing for receiving a portion of the lighter that extends outside the housing. The shell desirably is constructed of the same material as the housing to enhance the aesthetics of the smoking device.

Desirably, the housing includes an inner wall that defines a continuous passage extending through the housing that includes the first and second chambers. The smoking assembly may also include a thin spacer or the like extending across the passage and separating the first chamber from the second chamber. The housing desirably is constructed of any suitable material, such as, for example, aluminum or other metal.

The present invention in accordance with a preferred embodiment provides a complete and compact smoking assembly for storing and smoking material. The housing stores the smoking material and contains the lighter and smoking pipe in a neat and compact manner such that the smoking assembly is easy to store and transport. Additionally, the lighter has a compact configuration and is contained substantially within the housing in a manner such that it is easy and convenient to use to ignite smoking material received by the smoking pipe and such that the smoking assembly has an aesthetically-pleasing appearance.

BRIEF DESCRIPTION OF DRAWINGS

The present invention and the advantages thereof will become more apparent upon consideration of the following detailed description when taken in conjunction with the accompanying drawings of which.

DETAILED DESCRIPTION OF THE PREFERRED EMBODIMENTS

Figure 1:
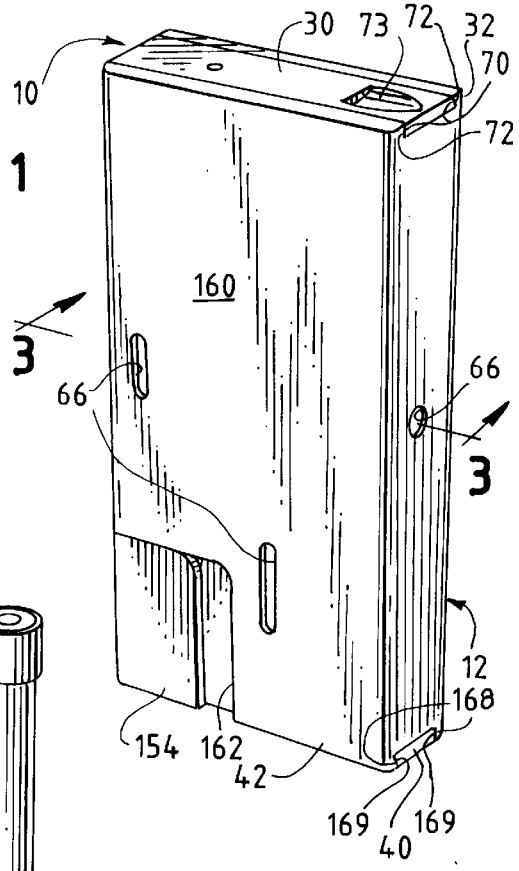
FIG. 1 is a perspective view of a smoking assembly in accordance with a preferred embodiment of the invention.
Figure 2:
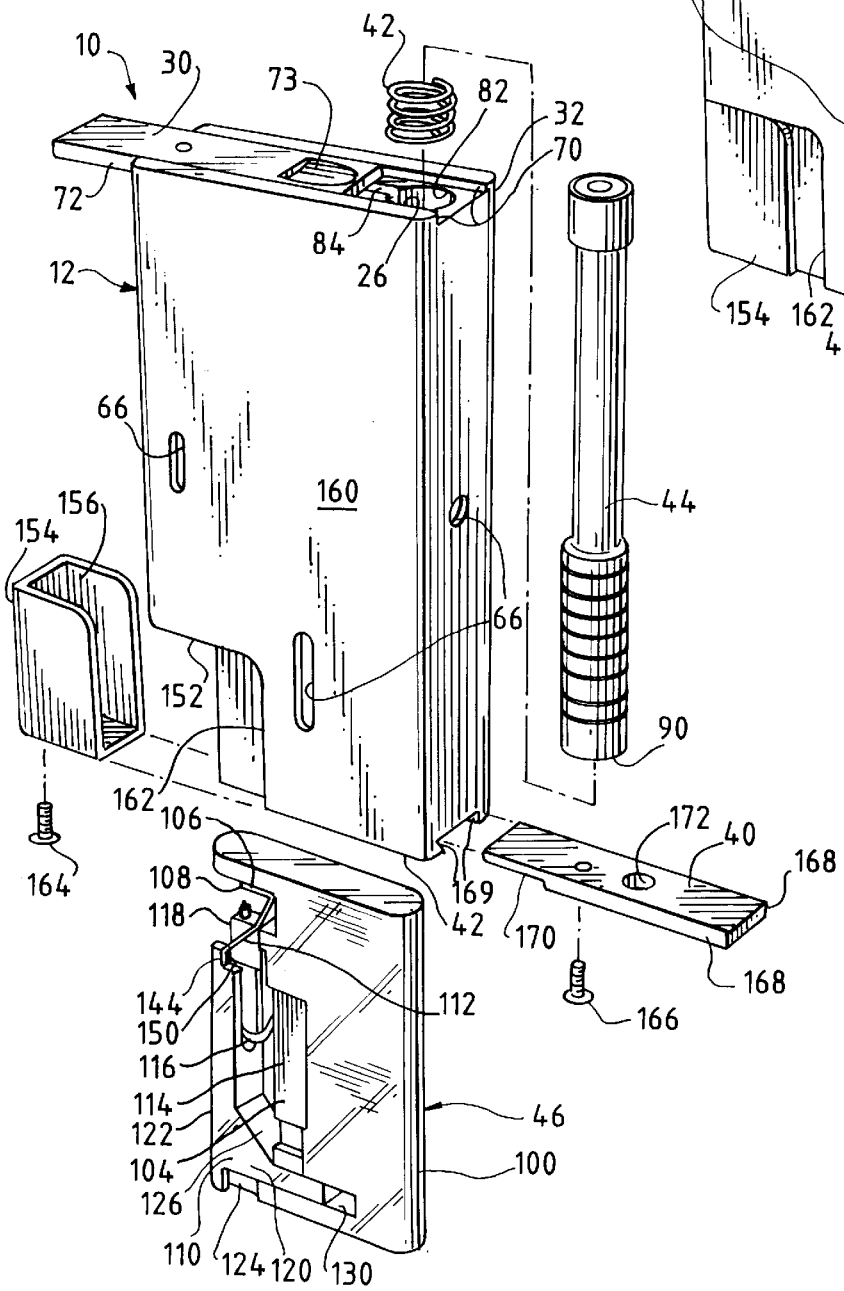
FIG. 2 is an exploded perspective view of the smoking assembly of FIG. 1.
Figure 3:
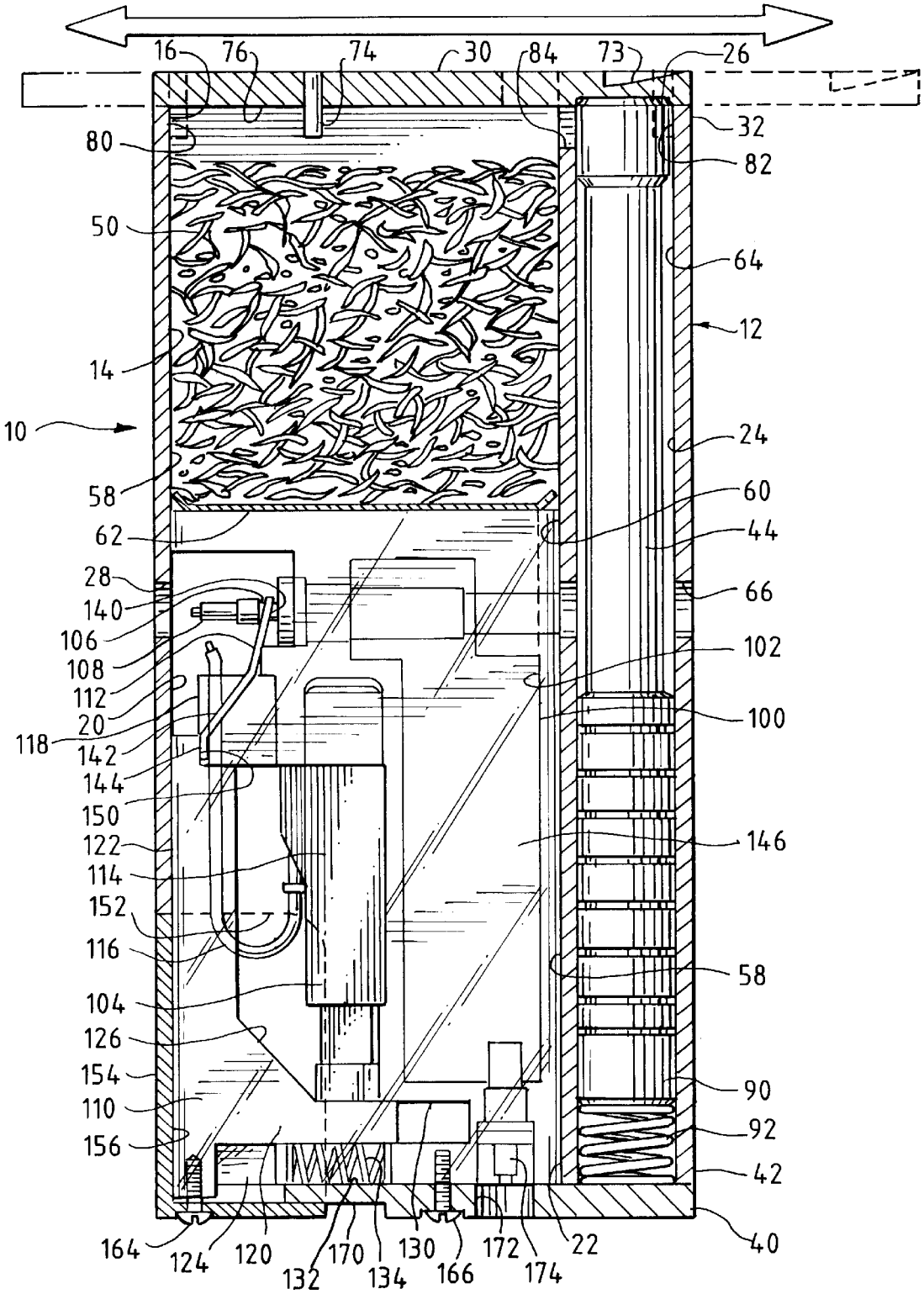
FIG. 3 is a cross section view taken along the lines 3—3 of FIG. 1, illustrating with an arrow and dashed lines the sliding action of the top cover.

FIGS. 1–3 disclose a smoking assembly 10 in accordance with a preferred embodiment of the invention. The illustrated smoking assembly 10 includes a housing 12 that defines a first chamber 14 having an open end 16, a second chamber 20 having an open end 22, an elongated channel 24 having an open end 26, and an aperture 28, a first or top cover 30 slidably mounted to one longitudinal end 32 of the housing for opening and closing the open end of the first chamber and for opening and closing the open end of the elongated channel; a second or bottom cover 40 rigidly mounted to the other longitudinal end 42 of the housing for partially enclosing the second chamber; a removable smoking pipe 44 receivable within the elongated channel; and a refillable lighter 46 fixedly contained substantially within the second chamber of the housing.

In accordance with a preferred embodiment, the first chamber 14 is adapted to store smoking material 50, and the smoking pipe 44 can be removed from the channel 24 and used to remove a portion of the smoking material 50 from the first chamber 14. The smoking pipe 44 holds the portion of the smoking material for smoking while the portion is being ignited outside the housing 12 by the lighter 46, which emits flame through the aperture 28. Desirably, the aperture 28 is located on a side of the housing 12. The open end 16 of the first chamber 14 and the open end 26 of the channel 24 desirably are disposed at or adjacent the one end 32 of the housing 12, and the open end 22 of the second chamber 20 desirably is disposed at or adjacent the other end 42 of the housing 12.

In the illustrated embodiment, the housing 12 includes an inner wall 58 that defines a passage 60 that extends through the housing substantially along the length of the housing. The passage 60 includes the first chamber 14 and the second chamber 20 which are substantially aligned with each other and which may be separated from each other in any suitable manner such as, for example, by a thin spacer 62 which defines the base of the first chamber 14 and which can be used for tamping of the smoking pipe 44. The illustrated spacer 62 is generally rectangular and includes rounded corners to complement the periphery of the inner wall 58. Desirably, the edge of the spacer 62 is curved around its periphery toward the open end 16 of the first chamber 14 to provide a bowl effect to facilitate removal of the smoking material. The elongated channel 24 is defined by an inner channel wall 64 preferably extending substantially the entire length of the housing 12. The elongated channel 24 is substantially parallel to the first and second chambers 14 and 20. The housing may include a plurality of vents 66. The housing 12 may be constructed of any suitable material, such as, for example, aluminum or other metal.

The top cover 30 desirably is slidably mounted to the housing 12 in any suitable manner. In the illustrated embodiment, for example, the housing 12 includes a pair of inclined walls 70 and the sides 72 of the top cover 30 are inclined in a complementary manner to engage and permit sliding of the top cover. Preferably, the top cover 30 is adapted to be slid in one direction to open the open end 26 of the channel 24 to allow access to the smoking pipe 44, and in the other direction to open the open end 16 of the first chamber 14 to allow access to the smoking material 50. The illustrated top cover 30 includes a finger grip in the form of an indentation 73.

In a preferred embodiment, the top cover 30 includes a limit in the form of a stud 74 extending from the bottom 76 of the top cover, and the housing 12 defines a pair of opposed contact surfaces 80, 82 for contacting the stud to limit the movement of the top cover 30 in either direction. In the illustrated embodiment, the contact surface 80 is defined by the inner wall 58 at one side of the housing 12, and the contact surface 82 is defined by the inner channel wall 64 at the other side of the housing 12. The housing 12 desirably defines a recess 84 through the inner wall 58 and the inner channel wall 64 for allowing passage of the stud 74 completely therethrough so that the open end 16 of the first chamber 14 is completely open when the stud is slid completely in one direction (e.g., to the right in FIG. 3).

The stud 74 desirably is disposed at a location on the bottom 76 of the top cover 30 such that, when the top cover is slid completely in one direction (e.g., to the left in FIG. 3) and the stud is in contact with the contact surface 80, the open end 26 of the channel 24 is completely open to allow access to the smoking pipe 44 and the open end 16 of the first chamber 14 remains closed by the top cover; and, when the top cover is slid in the other direction (e.g., to the right in FIG. 3) and the stud is in contact with the contact surface 82, the open end of the channel is closed by the top cover and the first chamber 14 is completely open to allow access to the smoking material 50. As a result, in accordance with this embodiment, the smoking pipe 44 can be removed from the channel 24 after the top cover 30 is slid completely in one direction (e.g., to the left in FIG. 3), and can then be used to remove smoking material 50 from the first chamber 14 after the top cover is slid completely in the other direction (e.g., to the right in FIG. 3).

The smoking pipe 44 desirably is hollow and elongated and includes a bowl 90 disposed at one end of the smoking pipe for repeatedly receiving and engaging smoking material 50 for smoking. The smoking assembly 10 desirably further includes a biasing element 92, such as a spring, disposed within the channel 24. The biasing element 92 is compressed by the smoking pipe 44 when the smoking pipe is within the channel 24 and the open end 26 of the channel is closed by the top cover 30 (see, e.g., FIG. 3). When the open end 26 of the channel 24 is open, the biasing element 92 biases or pushes the smoking pipe 44 so that a portion of smoking pipe extends outside the housing 12 and can be grasped for use.

The lighter 46 desirably is constructed to be contained substantially within the second chamber 20 of the housing 12 in a neat and compact manner. In the illustrated embodiment, the lighter 46 is generally rectangular and relatively thin and compact. The lighter 46 includes a lighter housing 100 defining a lighter fluid chamber 102 for storing lighter fluid; an igniter 104 for creating a spark; a valve stem 106 in fluid flow communication with the lighter fluid chamber having a valve 108 adapted to move from a closed position to an open position to release lighter fluid; a lighter switch 110; and a lever arm 112 engaged with the lighter switch and the valve and adapted to move the valve to the open position and to activate the igniter in response to the application of manual pressure to the lighter switch.

The longitudinal axis of igniter 104 desirably extends generally perpendicular to the longitudinal axis of the valve stem 106 (see FIG. 3). This configuration enables the lighter 46 to be positioned within the housing 12 such that a rear portion of the lighter switch 110 is disposed at or adjacent the other end 42 of the housing 12 so that the lighter switch is activatable adjacent the other end of the housing 12. The valve stem 106 is disposed adjacent the aperture 28 of the housing 12 so that the flame emitted from the valve stem passes through the aperture. The igniter 104 desirably includes an elongated igniter housing 114 and a conduit 116 extending from the igniter housing through a conduit support 118 and terminating adjacent the valve stem 106.

The illustrated lighter switch 110 is generally L-shaped and includes a base 120 and an arm 122. A boss 124, having a generally square or rectangular cross section, may be included adjacent the base 120. A camming surface 126 is defined at the bottom of the juncture of the base 120 and the arm 122 to activate the igniter 104 as pressure is applied to the lighter switch 110. The lighter housing 100 defines a slot 130 that slidingly receives and engages the arm 122 so that the lighter switch 110 can be moved to activate the igniter 104 and apply pressure to the lever arm 112 to open the valve 108. The lighter 46 also defines a bore 132 and includes a spring 134 received within the bore to apply pressure to the boss 124 during activation of the lighter switch 110 to bias the switch to the unactivated position.

The illustrated lever arm 112 desirably is bent, and includes a pair of forked members 140, 142 for receiving the valve stem 106 on one end and the conduit support 118 on the other end. The lever arm 112 also includes a flange 144 on the one end in contact with the bottom of the arm 122. When the lighter switch 110 is activated, a downward force is applied to the flange 144 which causes the one end of the lever arm 112 to move the valve 108 to the open position. A recess 150 may be defined on the bottom of the arm 122 for receiving the flange 144 and the conduit support 118.

The housing 12 defines a generally rectangular void 152 contiguous with the second chamber 20 to facilitate manual activation of the lighter switch 110. In the illustrated embodiment, a shell 154, which defines a cavity 156 for receiving a rear portion of the lighter 46 extending outside of the housing 12, is secured to the lighter 46 to enhance the aesthetics of the smoking assembly 10. The shell 154 desirably is constructed of the same material as the housing 12 and substantially fills the generally rectangular void 152. The lighter 46 is activated by applying pressure to the shell 154 such as, for example, by squeezing together the shell and the housing adjacent the other end 42 of the housing.

The outer opposed side walls 160 of the housing 12 may include a generally recessed area 162 adjacent the void 152 to receive and slidingly engage the shell 154 and to permit sliding movement of the shell relative to the housing 12 when the lighter switch 110 is being activated. In the illustrated embodiment, the shell 154 is secured to the lighter 46 by a fastener 164, such as a screw.

The bottom cover 40 is also secured to the lighter 46 by a fastener 166, such as a screw, and has inclined walls 168 that slidingly engage inclined walls 169 of the housing. The bottom cover 40 may include a lip 170 extending underneath a portion of the shell 154 to facilitate sliding action of the shell relative to the bottom cover. The bottom cover 40 desirably defines an aperture 172 positioned adjacent a lighter fluid port 174 included with the lighter 46 so that lighter fluid can be readily added to the lighter fluid chamber 102.

Accordingly, the present invention provides a complete and compact smoking assembly 10 that is easy to use and transport. The housing 12 can store the smoking material 50, receive the smoking pipe 44 and house the lighter 46 in a neat and compact manner. The lighter 46 desirably is contained within the housing 12 such that it is easy and convenient to use and enables the smoking assembly 10 to have a generally rectangular appearance and aesthetically pleasing appearance.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A smoking assembly comprising:

(a) a housing defining a first chamber for storing smoking material, an aperture, and a channel, the first chamber having an open end;

(b) a cover associated with the housing for opening and closing the open end of the first chamber;

(c) a smoking pipe for receiving a portion of the smoking material and for removing the portion of the smoking material from the first chamber for smoking,the smoking pipe adapted to be removably received by the channel; and (d) a lighter container substantially within the housing adapted to emit a flame through the aperture for igniting outside the housing the portion of the smoking material received by the smoking pipe.

2. The smoking assembly of claim 1 wherein the housing further defines a second chamber, the second chamber substantially receiving the lighter.

3. The smoking assembly of claim 2 wherein the lighter includes a valve stem adapted to be in fluid flow communication with lighter fluid contained within the housing, a lighter switch for igniting lighter fluid released by the valve stem, and an igniter adapted to emit a spark in response to application of pressure to the lighter switch.

4. The smoking assembly of claim 3 wherein the igniter has a longitudinal axis that extends substantially perpendicular to a longitudinal axis of the valve stem.

5. The smoking assembly of claim 3 wherein the housing has a pair of longitudinal ends, the lighter switch being positioned to be activatable adjacent one of the longitudinal ends of the housing.

6. The smoking assembly of claim 3 wherein the aperture is defined by a side of the housing, and the valve stem is positioned adjacent the aperture and is contained within the housing.

7. The smoking assembly of claim 3 wherein the valve stem includes a valve adapted to move from a closed position to an open position and a lever arm engaging the lighter switch and the valve stem, the lighter switch adapted to apply pressure to the lever arm to simultaneously move the valve to the open position to release lighter fluid and activate the igniter in response to application of said pressure to the lighter switch.

8. The smoking assembly of claim 2 wherein the housing includes an inner wall defining a passage that extends substantially the entire length of the housing, the inner wall also defining the first and second chambers.

9. The smoking assembly of claim 8 further including a spacer extending across the passage and separating the first and second chambers from each other.

10. The smoking assembly of claim 2 wherein the housing defines a generally rectangular void contiguous with the second chamber and a portion of the lighter extending outside of the housing is received by the void, the lighter having a lighter switch that is activatable outside of the housing.

11. The smoking assembly of claim 10 further including a shell that defines a cavity for receiving said portion of the lighter such that the housing and the shell together have a generally rectangular configuration.

12. The smoking assembly of claim 11 wherein the shell is slidingly engaged with the housing.

13. The smoking assembly of claim 1 wherein the channel defined by the housing has an open end and the cover is also adapted to open and close the open end of the channel.

14. The smoking assembly of claim 13 wherein the cover is slidably mounted to the housing.

15. The smoking assembly of claim 14 wherein a bottom of the cover includes a stud and the housing includes a pair of opposed contact surfaces for contacting the stud to limit the sliding movement of the cover in either direction.

16. The smoking assembly of claim 15 wherein the open end of the channel is open and the open end of the first chamber is closed when the stud is contacting one of the contact surfaces, and the open end of the elongated channel is closed and the open end of the first chamber is open when the stud is contacting the other contact surface.

17. The smoking assembly of claim 16 wherein the first chamber is defined by an inner wall and the channel is defined by an inner channel wall, the housing defining a recess between the opposed contact surfaces and through the inner wall and inner channel wall, the stud adapted to pass through the recess during sliding of the cover.

18. The smoking assembly of claim 13 further including a biasing element received within the channel,the biasing element adapted to compress when the smoking pipe is received within the channel and the open end of the channel is closed by the cover, and the biasing element is adapted to bias the smoking pipe when the cover is moved open the open end of the channel.

19. A smoking assembly comprising:

(a) a housing defining a first chamber for storing smoking material, a second chamber, an elongated channel, and an aperture, the first chamber and the elongated channel each having an open end;

(b) an elongated smoking pipe removably receivable within the channel adapted to receive a portion of the smoking material and to remove the portion of the smoking material from the first chamber for smoking;

(c) a cover associated with the housing for opening and closing the open end of the first chamber and for opening and closing the open end of the channel; and (d) a lighter contained substantially within the second chamber of the housing adapted to emit a flame through the aperture for igniting, outside of the housing, the portion of the smoking material received by the smoking pipe.

20. The smoking assembly of claim 19 wherein the lighter includes a valve stem adapted to release lighter fluid contained within the lighter and a lighter switch for igniting the lighter fluid released by the valve stem, and wherein the housing has a pair of longitudinal ends separated by the length of the housing, the lighter switch being positioned to be activatable adjacent one of the longitudinal ends of the housing.

21. The smoking assembly of claim 20 wherein the lighter further includes an igniter having a longitudinal axis that extends substantially perpendicular to a longitudinal axis of the valve stem.

22. The smoking assembly of claim 20 wherein the aperture is defined by a side of the housing, and the valve stem is positioned adjacent the aperture and is contained within the housing.

23. The smoking assembly of claim 19 wherein the housing includes an inner wall defining a passage that extends substantially the entire length of the housing, the inner wall also defining the first and second chambers, and wherein the smoking assembly further includes a spacer separating the first and second chambers from each other.

24. The smoking assembly of claim 23 wherein the spacer includes a curved edge substantially around the periphery of the spacer, the curved edge extending toward the open end of the first chamber.

25. The smoking assembly of claim 19 wherein the cover is slidably mounted to the housing.

* * * * *

UNITED STATES PATENT AND TRADEMARK OFFICE

CERTIFICATE OF CORRECTION

PATENT NO. : 5,848,596

DATED : December 15, 1998

INVENTOR(S) : Steven E. Zelenik

It is certified that error appears in the above-indentified patent and that said Letters Patent is hereby corrected as shown below:

Column 6, Line 66 "move open" should be -- moved to open --

Signed and Sealed this

Eighteenth Day of July, 2000

*Attest:*

Q. TODD DICKINSON

*Attesting Officer*

*Director of Patents and Trademarks*